United States Patent [19]

Mugele

[11] Patent Number: 4,484,457

[45] Date of Patent: Nov. 27, 1984

[54] LIQUID-RING VACUUM PUMP PRECEDED BY A PRECOMPRESSOR

[75] Inventor: Kurt Mugele, Erlangen, Fed. Rep. of Germany

[73] Assignee: Siemens Aktiengesellschaft, Berlin and Munich, Fed. Rep. of Germany

[21] Appl. No.: 461,505

[22] Filed: Jan. 27, 1983

[30] Foreign Application Priority Data

Feb. 11, 1982 [DE] Fed. Rep. of Germany ..... 3204784

[51] Int. Cl.[3] ..... F25B 1/06

[52] U.S. Cl. ..... 62/500; 62/100; 62/116; 62/268; 417/69

[58] Field of Search ..... 62/500, 116, 100, 268; 417/69

[56] References Cited

U.S. PATENT DOCUMENTS

| | | | |
|---|---|---|---|
| 3,481,529 | 12/1969 | Mugele | 417/69 |
| 3,575,532 | 4/1971 | Mugele et al. | 417/69 |
| 3,973,879 | 8/1976 | Ramm | 417/69 |
| 4,385,868 | 5/1983 | King | 417/69 |

OTHER PUBLICATIONS

Siemens Brochure E 7251046.

*Primary Examiner*—Ronald C. Capossela
*Attorney, Agent, or Firm*—Kenyon & Kenyon

[57] ABSTRACT

In a vacuum generating system having a liquid ring vacuum pump preceded in a gas flow path by a precompressor and followed by a liquid separator, the precompressor is driven by steam produced in a heat exchanger in contact with the working fluid of the vacuum pump. The working fluid is kept at a temperature exceeding the boiling point of water.

7 Claims, 2 Drawing Figures

LIQUID-RING VACUUM PUMP PRECEDED BY A PRECOMPRESSOR

BACKGROUND OF THE INVENTION

The present invention relates to a liquid-ring vacuum pump preceded by a precompressor (or supercharger) and followed by a liquid separator, a heat exchanger being provided for transferring heat to a coolant, e.g., water, from a working fluid which has a higher boiling point than that of water.

In a vacuum generating system such as that described, for instance in Siemens Brochure E 7251046, the vacuum pump draws in gas and pushes it together with part of the working liquid, e.g., oil, into the liquid separator, which is disposed on the pressure side of the pump. The compressed gas leaves the separator via an output stub at the top thereof, while the working liquid flows back into the vacuum pump. The heat which is absorbed by the working liquid owing to compression and friction is transferred to the cooling water by means of a heat exchanger located in the working-liquid loop. The cooling water, initially having a temperature of 15° C., for example, is warmed up to the normal working-liquid temperature of 25° to 30° C. and in general is of no further use unless the temperature is brought to a higher level by an expensive heat pump. The friction and compression heat energy which comes in thelast analysis from the operating motor of the vacuum pum is, therefore, lost as a rule.

An object of the present invention is to provide a vacuum generating system in which at least part of this heat is used.

SUMMARY OF THE INVENTION

According to the invention, this object is attained by the provision that the operating temperature of the working liquid in the pump and the separator is above the boiling point of the cooling water, energy for operating the precompressor being sup-plied by the steam generated in the heat exchanger. In this manner it is possible to use, without great expense, not only the heat pro-duced by friction and by the compression of the working fluid but also (in all "wet" vacuum processes) the heat content contained in the drawn-off steam component.

If a jet pump is used as the precompressor in a manner known in the art, the steam produced in the heat exchanger can serve as the propellant for the jet pump. If a side-canal gas-ring compressor is used as the precompressor, the steam can be used to propel a flow engine, for instance, a turbine, coupled to the compressor.

So as not to load the pump unnecessarily, the steam produced in the system is advantageously separated as far as possible in a con-denser disposed between the precompressorand the pump.

DETAILED DESCRIPTION OF THE INVENTION

Figure 1:
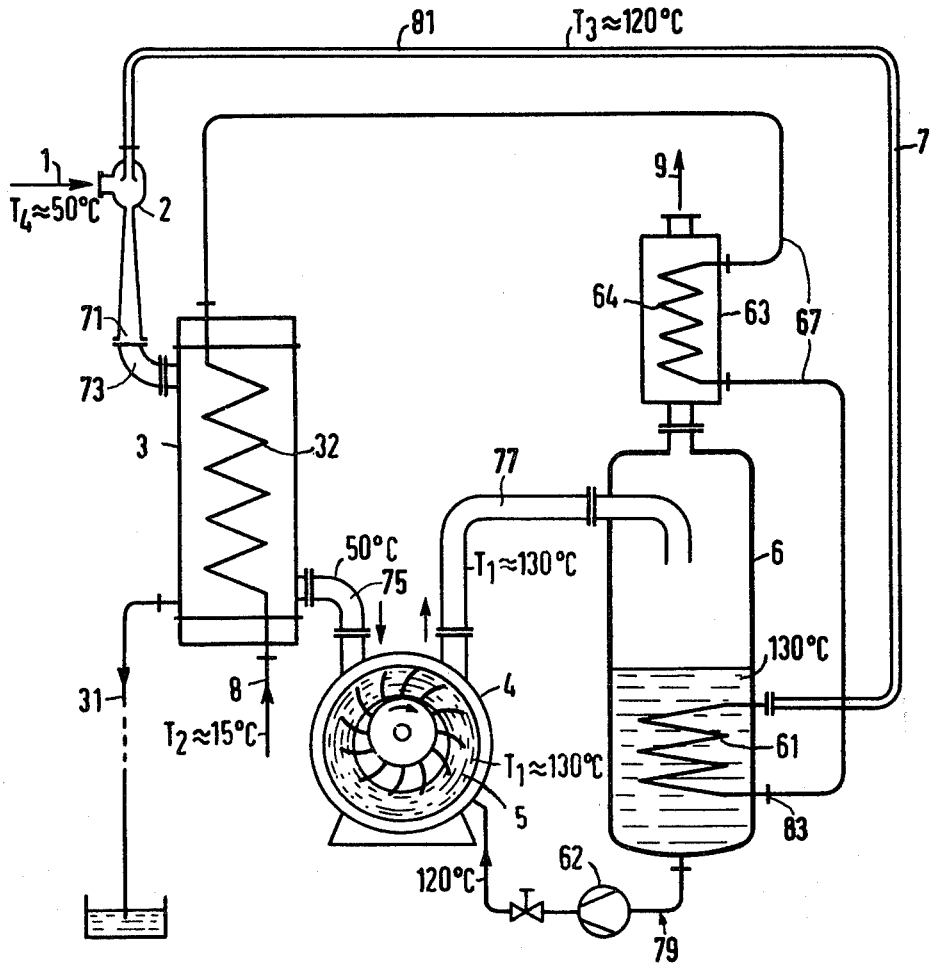
FIG. 1 is a diagram of a vacuum generating system showing a pre-compressor in the form of a jet pump driven by recycled energy in accordance with the present invention.

A gas mixture represented by an arrow 1 at an input of a steam ejector or jet pump 2, the mixture initially having a temperature T4 of approximately 50° C., is to be compressed in the vaccum generating system to atmospheric pressure and vented into the atmosphere as a relatively clean gas represented by an arrow 9. For this purpose the mixture 1 is first precompressed in jet pump 2 by a factor 1.5 and transported with the steam or vapor from a nozzle output 71 of jep pump 2 via a conduit 73 to a condenser 3 in which the vapor is condensed as far as possible. The separated liquid is discharged via a barometric tube 31. From the condenser 3, uncondensed gas-vapor mixture is transported at 50° C. via a gas flow duct 75 to a liquid-ring vacuum pump 4. This pump operates with a working fluid 5 such as oil which has a boiling point, for instance, of 500° C. The working liquid 5 is warmed up by the compression energy and friction to a temperature T1=130° C. In liquid-ring vacuum pump 4 the vapor-gas mixture 1 is compressed to atmospheric pressure; from the pump the gas is subsequently transported together with part of the working liquid 5 to a liquid separator 6 via a duct 77 serving as part of both a gas flow path and a liquid flow circuit 79 which also includes a pump 62, as well as separator 6. At a temperature T1 of approximately 130° C., the working liquid is separated in separator 6 from the gas. The so purified gas of atmospheric pressure is then transported through an emission cooler 63, whereby residual moisture is separated, and is vented to the atmosphere as purified gas 9 at atmospheric pressure. It would be conceivable to feed the gas to a further processing stage prior to release of the gas into the air.

The working liquid 5 accumulated in separator 6 is returned at a temperature of approximately 120° C. to pump 4 via pump 62.

In a vacuum generating system according to the present invention, much of the energy for operating jet pump 2 is obtained from working liquid 5. A coolant 8 such as water with an initial temperature T2 of, say 15° C. is first preheated to 40° C. in condenser 3 by means of a heat exchanger 32. From there the coolant is transported via conduits 67 and a heat exchanger 64 in emission cooler 63 to a coolant input 83 of a heat exchanger 61 in separator 6. Upon reaching heat exchanger 61, the coolant has a temperature, for example, of 60° C. The coolant evaporates in exchanger 61 because of the 130° temperature of working liquid 5 and is transported via a conduit 7 to jet pump 2 in the form of saturated or super-saturated steam 81 having a temperature T3=120° C. The saturated steam serves as the propellant for jet pump 2.

It is to be noted that the boiling point of fluid 5 is substantially greater than the boiling point of coolant 8, i.e., of water. The difference facilitates the generation in exchanger 61 of vaporized coolant in the form of super-saturated steam. Heat exchanger 61 must, of course, be in contact with the working fluid in liquid flow circuit 79. It is not necessary that the heat exchanger be disposed in that part of the liquid flow circuit represented by separator 6.

By the utilization of the compressor losses described above for driving the jet pump, an overall system is obtained which consumes about $\frac{1}{3}$ less energy than a corresponding system heretofore, consisting of a pump and precompressor.

Figure 2:
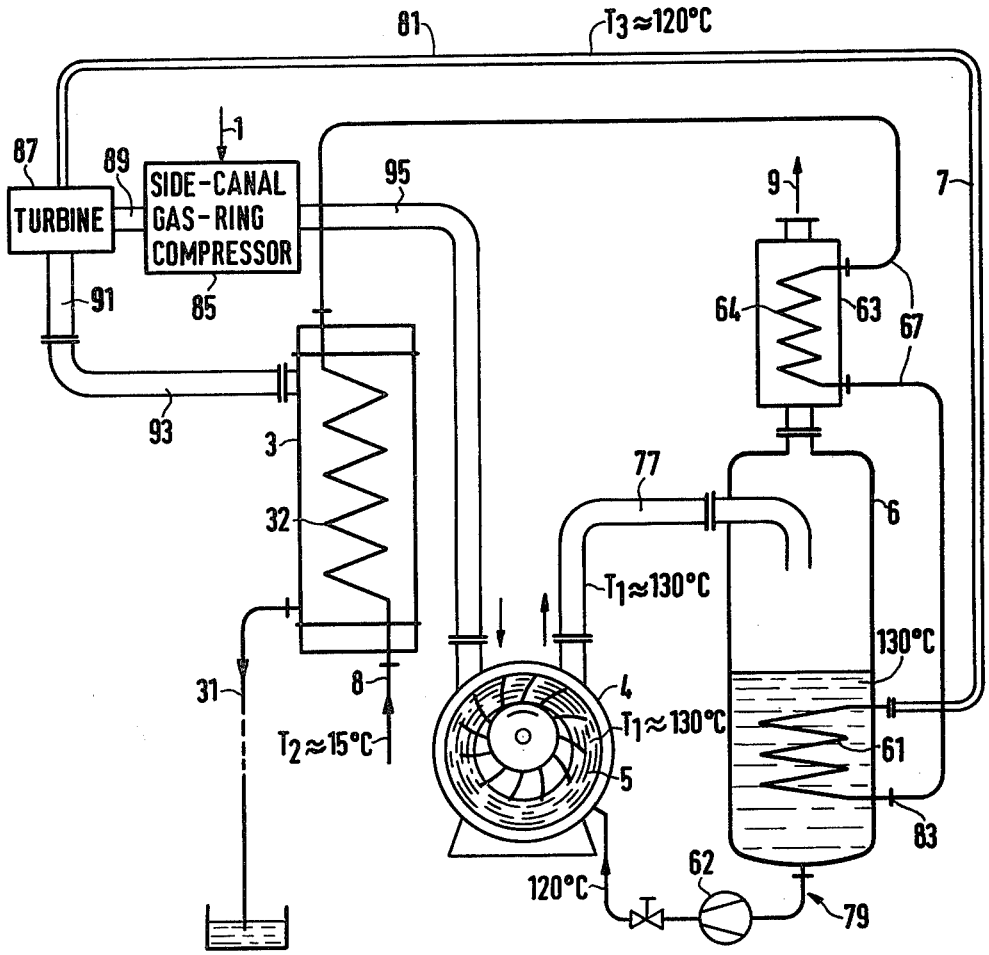
FIG. 2 is a diagram similar to FIG. 1, wherein the precompressor is in the form of a side-canal gas-ring compressor.

As illustrated in FIG. 2, the precompressor may take the form of a side-canal gas-ring compressor 85. The compressor is driven by a turbine or flow engine 87 via a shaft 89. The turbine in turn is powered by the supersaturated steam 81 carried by conduit 7 from exchanger 61. An output 91 of turbine 87 is connected to condenser 3 via a duct 93, while an output of compressor 85 is coupled to an input of the liquid ring vacuum pump 4 via a conduit 95. Other reference numerals in FIG. 2 have the same meaning and represent the same structual features as in FIG. 1.

What is claimed is:

1. A vacuum generating system comprising:

a liquid ring vacuum pump having a gas inlet, a gas mixture outlet and a working fluid inlet;

a liquid separator connected at an input to said gas mixture outlet of said pump for receiving a compressed gas and fluid mixture therefrom, said separator being connected at a fluid output of said working fluid inlet of said pump for delivering thereto working fluid at least partially separated from said compressed gas and fluid mixture;

a precompressor having a gas outflow port connected to said gas inlet of said pump for delivering thereto partially compressed gas for further compression;

heat transfer means, in contact with working fluid circulating between said separator and said pump, for transferring heat energy from said working fluid to a coolant, said working fluid having a higher boiling point than the boiling point of said coolant, the operating temperature of said fluid in said pump and said separator being higher than the boiling point of said coolant; and conduit means extending between said heat transfer means and said precompressor for transporting thereto from said heat transfer means said coolant in vaporized form for driving said precompressor.

2. The improvement defined in claim 1 wherein said precompressor is in the form of a jet pump, the vaporized coolant transported from said heat transfer means by said conduit means serving as the propellant of said jet pump.

3. The improvement defined in claim 2 wherein said conduit means further extends from an output of said precompressor to a coolant input of said heat transfer means for transporting coolant thereto from said precompressor, said conduit means including a section traversing a condenser between the output of said precompressor and the coolant input of said heat transfer means at least in part for preheating said coolant prior to transfer thereof to said heat transfer means.

4. The improvement defined in claim 1 wherein said precompressor is in the form of a side-canal gas-ring compressor powered by a flow engine, said conduit means being connected to said engine for feeding thereto vaporized coolant from said heat transfer means.

5. The improvement defined in claim 1 wherein said system includes an emission cooler at a gas output of said separator and said conduit means extends through said cooler from an output of said precompressor to a coolant input of said heat transfer means for preheating in said cooler said coolant prior to transport thereof to said heat transfer means.

6. The improvement defined in claim 1 wherein said conduit means further extends from an output of said precompressor to a coolant input of said heat transfer means for transporting coolant thereto from said precompressor, said conduit means including a section traversing a condenser between the output of said precompressor and the coolant input of said heat transfer means at least in part for preheating said coolant prior to transfer thereof to said heat transfer means.

7. In a vacuum generating system including a liquid ring vacuum pump, a liquid separator and a precompressor, said pump having a gas inlet, a gas mixture outlet and a working fluid inlet, said separator having an input connected to said gas mixture outlet of said pump for receiving a compressed gas and liquid mixture therefrom, said separator further having a fluid output connected to said working fluid inlet of said pump for delivering thereto working fluid at least partially separated from said compressed gas and fluid mixture, said precompressor having a gas outflow port connected to said gas inlet of said pump for delivering thereto partially compressed gas for further compression, said vacuum generating system further including heat transfer means for transferring heat energy from said working fluid to a coolant, said heat transfer means being in the contact with said working fluid circulating between said separator and said pump, said working fluid having a higher boiling point than the boiling point of said coolant, the improvement wherein said vacuum generating system includes conduit means extending between said heat transfer means and said precompressor for transporting thereto from said heat transfer means said coolant in vaporized form for driving said precompressor, the operating temperature of said working fluid in said pump and said separator being higher than the boiling point of said coolant.

* * * * *